US010683194B2

(12) United States Patent
Willim et al.

(10) Patent No.: US 10,683,194 B2
(45) Date of Patent: Jun. 16, 2020

(54) APPARATUS FOR STABILIZING A CRANE

(71) Applicant: Liebherr-Werk Ehingen GmbH, Ehingen (DE)

(72) Inventors: Hans-Dieter Willim, Ulm-Unterweiler (DE); Roland Bohnacker, Blaubeuren (DE); Markus Zeiler, Ehingen (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 142 days.

(21) Appl. No.: 15/705,623

(22) Filed: Sep. 15, 2017

(65) Prior Publication Data

US 2018/0072541 A1 Mar. 15, 2018

(30) Foreign Application Priority Data

Sep. 15, 2016 (DE) ..... 10 2016 011 189

(51) Int. Cl.
*B66C 23/88* (2006.01)
*B66C 23/78* (2006.01)

(52) U.S. Cl.
CPC ..... *B66C 23/88* (2013.01); *B66C 23/78* (2013.01)

(58) Field of Classification Search
CPC ..... B66C 23/78; B66C 23/76; B66C 23/88
See application file for complete search history.

(56) References Cited

U.S. PATENT DOCUMENTS 2,375,264 A * 5/1945 Wagner ..... B66C 23/78 180/6.58
2,918,181 A * 12/1959 Hanson ..... B66C 23/78 212/303
3,790,133 A * 2/1974 Jones ..... B66C 23/78 254/103
3,874,515 A * 4/1975 Leigh ..... B66C 23/78 212/195
4,266,679 A * 5/1981 Juergens ..... B66C 23/78 180/9.1
4,266,809 A * 5/1981 Wuerflein ..... B66C 23/78 280/766.1
4,280,627 A * 7/1981 Becker ..... B66C 23/36 212/197

(Continued)

FOREIGN PATENT DOCUMENTS

CA 2790152 A1 8/2011
DE 19842436 A1 3/2000

(Continued)

OTHER PUBLICATIONS

Photograph, Available Online at www.bauforum24.biz/uploads/2009/02/post-1734-1235847601.jpg, Available as Early as Jan. 2009, 1 page.

*Primary Examiner* — Emmanuel M Marcelo
(74) *Attorney, Agent, or Firm* — McCoy Russell LLP

(57) ABSTRACT

The present disclosure relates to an apparatus for stabilizing a crane, in particular a crawler crane, in an anchorage position, having at least one load coupled to a first boom of the crane to compensate a first torque introduced into the crane due to wind and having at least two additional supports arranged opposite one another to compensate a second torque introduced into the crane due to wind. The disclosure is furthermore directed to a corresponding additional support and to a crane having a corresponding apparatus.

14 Claims, 5 Drawing Sheets

(56) References Cited

U.S. PATENT DOCUMENTS

| | | | | |
|---|---|---|---|---|
| 4,394,913 | A * | 7/1983 | Lanning | B66C 23/78 212/304 |
| 4,446,976 | A * | 5/1984 | Imerman | B66C 23/78 212/175 |
| 4,640,421 | A * | 2/1987 | Mason | B66C 23/78 180/9.26 |
| 9,327,950 | B2 | 5/2016 | Mayer | |
| 9,550,475 | B1 * | 1/2017 | Walker | B66C 23/78 |
| 2007/0193749 | A1 * | 8/2007 | Folk | E21B 7/02 166/379 |
| 2009/0107946 | A1 * | 4/2009 | Karp | B66C 23/80 212/302 |
| 2012/0173094 | A1 * | 7/2012 | Steinich | B66C 23/78 701/50 |
| 2012/0279938 | A1 * | 11/2012 | Benton | G01B 11/02 212/277 |
| 2014/0116975 | A1 * | 5/2014 | Benton | B66C 23/88 212/302 |
| 2014/0202971 | A1 * | 7/2014 | Bosco | B66C 23/207 212/296 |
| 2016/0245917 | A1 * | 8/2016 | Schoonmaker | G01S 17/08 |
| 2018/0065833 | A1 * | 3/2018 | Stoof | B66C 23/74 |

FOREIGN PATENT DOCUMENTS

| | | | |
|---|---|---|---|
| DE | 29915375 | U1 | 1/2001 |
| DE | 102011119655 | A1 | 5/2013 |
| DE | 202012009167 | U1 | 2/2014 |
| DE | 102010008173 | B4 | 4/2015 |
| EP | 0994065 | A1 | 4/2000 |

* cited by examiner

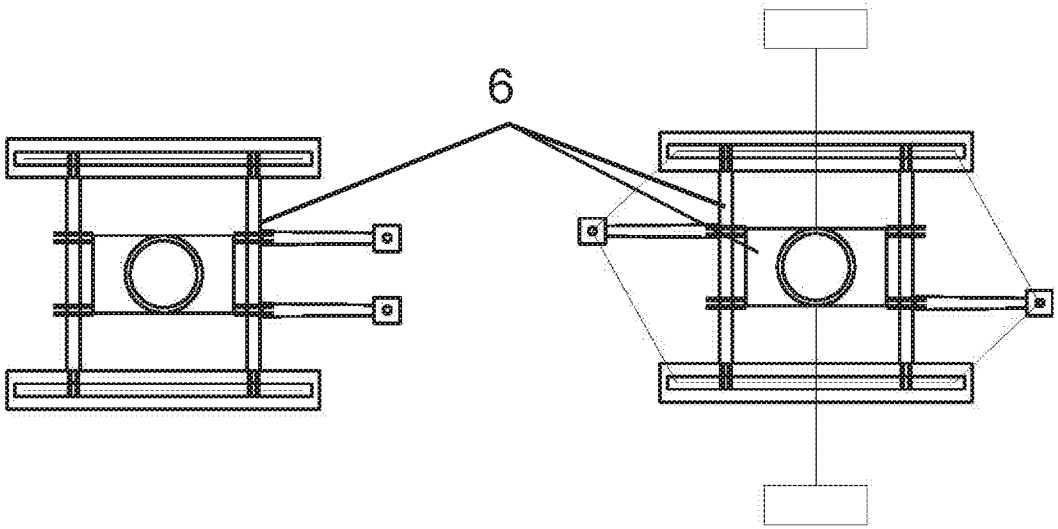
Fig. 2D
Fig. 2E
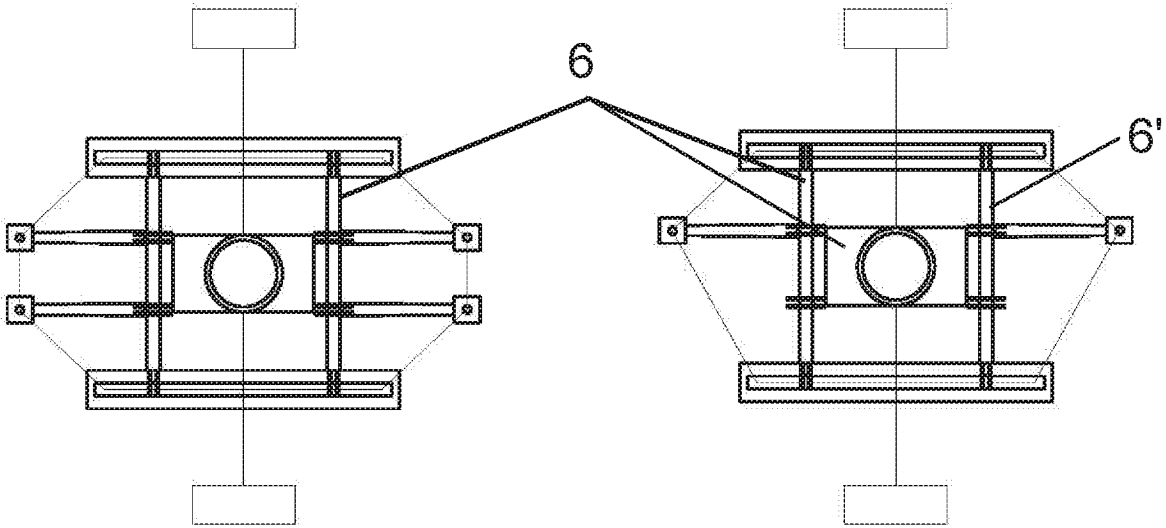
Fig. 2F
Fig. 2G

APPARATUS FOR STABILIZING A CRANE

CROSS REFERENCE TO RELATED APPLICATION

This application claims priority to German Patent Application No. 10 2016 011 189.5 entitled, "APPARATUS FOR STABILIZING A CRANE," filed Sep. 15, 2016, the entire contents of which is hereby incorporated by reference in its entirety for all purposes.

TECHNICAL FIELD

The present disclosure relates to an apparatus for stabilizing a crane, in particular a crawler crane, in an anchorage position, having at least one load coupled to a first boom of the crane to compensate a first torque introduced into the crane due to wind and having at least two additional supports arranged opposite one another to compensate a second torque introduced into the crane due to wind.

BACKGROUND AND SUMMARY

The apparatus is suitable for use with mobile cranes that can, for example, be crawler cranes having any desired lattice boom system and optionally having a derrick boom. The lattice boom system of the crane can have a main boom and a fly jib. Various guying frames can be provided to guy the different boom elements. The guying of the crane can be a holding function or also a movement function of a corresponding guying device. The guying can typically be guided over the guying frames. Corresponding drives provide the movement of the boom elements. The drives are, for example, of a hydraulic or electric kind. Hydraulic cylinders, winches or linear drives are known, for example.

The rotary movement of the superstructure or the rotary drive can be an element central to the present disclosure. Provision can thus be made that the crane is rotated by means of the rotary drive into an anchorage position, in particular in parallel with the expected main wind direction.

Very small movements are also possible that only serve to transfer forces. This is, for example, the case when a derrick ballast is supported on the ground. This ballast can have a mass of 100 metric tons (tonnes). Cylinders can then be attached to the tip of the derrick boom that are connected to the derrick ballast via a guying. These cylinders draw a force of, for example, 10 tonnes and introduce this force into the tip of the derrick boom.

Such cranes are complex and time-intensive in setting up. Taking down the crane is likewise complex and requires a certain amount of time. Moving the crane into defined positions also requires an amount of time that cannot be neglected. This is due to the large number of elements of the boom system and of the crane itself. The power required for setting up and/or modification of the crane is furthermore a limiting element due to the limited performance of the drives. The large lengths in the boom system are to be observed in this respect. The rope capacity of winches of known cranes is, for example, in an order of magnitude of 1000 m which accordingly have to be wound up or unwound in a time-intensive manner on a modification of the crane.

Such a crane may only be operated under certain circumstances. A criterion relating to the surrounding conditions of the crane is the wind speed, for example. Recognized specifications are known for this purpose. The specifications are stored in the monitoring of the crane (e.g. load moment limitation system or operating instructions) and are known to the operators of the crane. The maximum wind speed at which the crane may perform work is defined, for example. All the movements of the crane are called work in this case.

If the wind speed exceeds certain limit values, the crane has to be stopped and may not carry out any work. However, the unmoved crane also experiences a force from the wind. Consequently, the maximum permitted wind speed is also specified in the unmoved or parked state. The crane operator therefore bears the responsibility for always monitoring the wind speed to be expected and for putting the crane into a safe state in good time. This can make a complex and cost-intensive removal of the boom system necessary. It must be noted that a traveling or a movement of the total crawler crane will frequently be required for this purpose for reasons of space.

It is furthermore known for the erection of a long boom system to attach an additional support to a crane. This additional support displaces the tilting edge. Longer boom systems can thus be erected. DE 10 2011 119 655 A1 shows corresponding additional supports having the reference numeral 140. Two additional supports are required for it to be a real or sufficiently effective tilting edge. Both are attached to the side of the crawler crane undercarriage at which the boom system is pulled up. The additional supports are used to set up long boom combinations. The additional support, for example, may comprise two supports that are bolted to a single crawler carrier. Each additional support has a drive at its free end that can press a support plate onto the ground. This drive can take place manually via a spindle.

Against this background, it is the object of the present disclosure to provide an apparatus and a crane that make it possible to lower the frequency with which the complete taking down of the boom system is necessary. A system should thus be provided that increases the permitted wind speed for the stopped crane or for a crane that is out of operation. This system should equally be able to be used on both newly designed cranes and already existing cranes.

The object underlying the present disclosure is achieved by an apparatus for stabilizing a crane, in particular a crawler crane, in an anchorage position having at least one load coupled to a first boom of the crane to compensate a first torque introduced into the crane due to wind and having at least two additional supports that are arranged opposite one another to compensate a second torque introduced into the crane due to wind, wherein the second torque engages at the crane at an angle different from the first torque. Embodiments are the subject of the dependent claims.

The additional supports can in this respect be arranged at different angles to the crane or to the crane's own superstructure as its booms, whereby a wind force acting on the crane in the horizontal direction and the corresponding torque can be split over two components and can correspondingly be compensated by the additional supports, on the one hand, and by the boom arranged at an angle thereto, on the other hand. The term of compensation in the present case means that a force is introduced into the crane via the boom or via the additional supports from a load or from the ground region on which the additional supports are supported, said force countering the wind force or the corresponding torque. The terms of the two torques mean the torque components that are introduced into the crane by the wind force and into which the torque resulting from the wind force can be split.

The load mentioned here can, for example, be a hook-type bottom block, another load that is connected to the first boom of the crane, in particular via the hook-type bottom block, a kind of ground anchor or also any kind of mixed form. A load is to be understood such that the boom system of the crane is preloaded by the load.

It is conceivable in one embodiment that the additional supports are arranged at each crawler carrier of the crane. If a superstructure together with the boom of the crane is aligned in the direction of the crawler carriers or in parallel with the crawler carriers, the additional supports can, for example, be mounted at the crawler carriers at a right angle and can thereby also be positioned at a right angle to the crane boom. It is hereby possible in a particularly simple manner to compensate the torques or forces introduced by the wind via differently arranged or differently aligned components of the crane, namely the boom and the additional supports.

It is conceivable in an additional embodiment that the additional supports are arranged, in particular between the crawler carriers, indirectly or directly at a center frame part of the crane. Depending on the model of the crane, couplings possibly already present at the center frame part can thus be used for coupling the additional supports, whereby the performance of the method of the disclosure is advantageously simplified.

Provision can be made in another embodiment that the additional supports are arranged at connection carriers between the crawler carriers. Corresponding connection carriers can, for example, be provided as part of a retrofitting of a crane and can be utilized for a coupling as required of the additional supports to the center frame part or between the center frame part.

It is furthermore conceivable in another embodiment that the load is the hook-type bottom block of the crane. It is furthermore possible by the use of the block typically attached to the crane to simplify the performance of the method of the disclosure since no additional weights have to be provided in this context. In this respect, it is conceivable for performing the method of the disclosure to place the load down on the ground supporting the crane or alternatively not to place the load down and instead to leave it hanging.

It is conceivable in a further optional embodiment that a second load coupled to the crane, in particular via a second boom, is provided at the crane. The second boom can, for example, be a derrick boom having corresponding derrick ballast or another counterweight system. With a crane having a derrick boom, a part of the boom structure anyway present can thus be used for performing the method of the disclosure, whereby the latter is further simplified in its performance.

Provision can be made in another embodiment that at least one of the loads comprises two part loads arranged next to one another. It is possible by the design of at least one of the loads as a load system divided into two to no longer only block a force component of the wind load acting perpendicular to the boom plane of the crane solely via the slewing gear of the crane or via the slewing gear brake of the crane, but also to block at least some of the forces acting, for example, in the rotational direction of the superstructure of the crane by the part loads arranged in an offset manner. Provision can be made for this purpose that the connection between an outer end of the boom and the part load coupled to it is executed at a suitable angle.

An obtuse angle is advantageous for wind from the front; an acute angle is advantageous to support the slewing gear for wind from a lateral direction.

It is furthermore conceivable in an additional embodiment that the additional supports are arranged exactly opposite one another or opposite one another and offset. The additional supports can in this respect be arranged at two respective crawler carriers arranged next to one another and/or at two opposite sides of the center frame part indirectly or directly exactly opposite one another or opposite one another and offset.

It can furthermore be provided in another embodiment that the crawler carriers and/or the center frame part and/or the connection carriers each comprise exactly one or more couplings for coupling the additional supports. It is possible particularly simply and fast via the corresponding couplings to couple connection carriers to the respective points as required and thus to stabilize the crane in accordance with the disclosure. The couplings can also be couplings already provided at the crane for supports that additionally support the crane on the setting up of a long boom system.

The disclosure is furthermore directed to a crane having at least one apparatus for stabilizing the crane in an anchorage position having at least one load coupled to a first boom of the crane to compensate a first torque introduced into the crane due to wind, and having at least two additional supports that are arranged opposite one another to compensate a second torque introduced into the crane due to wind, wherein the second torque engages at the crane at an angle different from the first torque; and to an additional support for an apparatus comprising at least two additional supports arranged opposite one another to compensate a second torque introduced into a crane due to wind, wherein the second torque engages at the crane at an angle different from a first torque introduced into the crane due to wind. The crane can be retrofittable with the corresponding apparatus, with couplings, for example already present on the crane, for the coupling of supports being able to be coupled as described above as required with the additional supports provided in accordance with the disclosure. The additional support can, as described above, be couplable with the crane, with it also being able to comprise an actuator, in particular a hydraulic actuator, to support the crane against the supporting ground, the actuator being couplable to a hydraulic system of the crane.

Further advantages and details of the present disclosure are explained with reference to the embodiments shown by way of example in the Figures.

BRIEF DESCRIPTION OF THE FIGURES

FIG. 1 shows an additional support in accordance with the prior art.

FIGS. 2A-2I show different embodiments of the apparatus in accordance with the present disclosure.

DETAILED DESCRIPTION OF THE FIGURES

Figures 1, 2A, 2B, 2C:
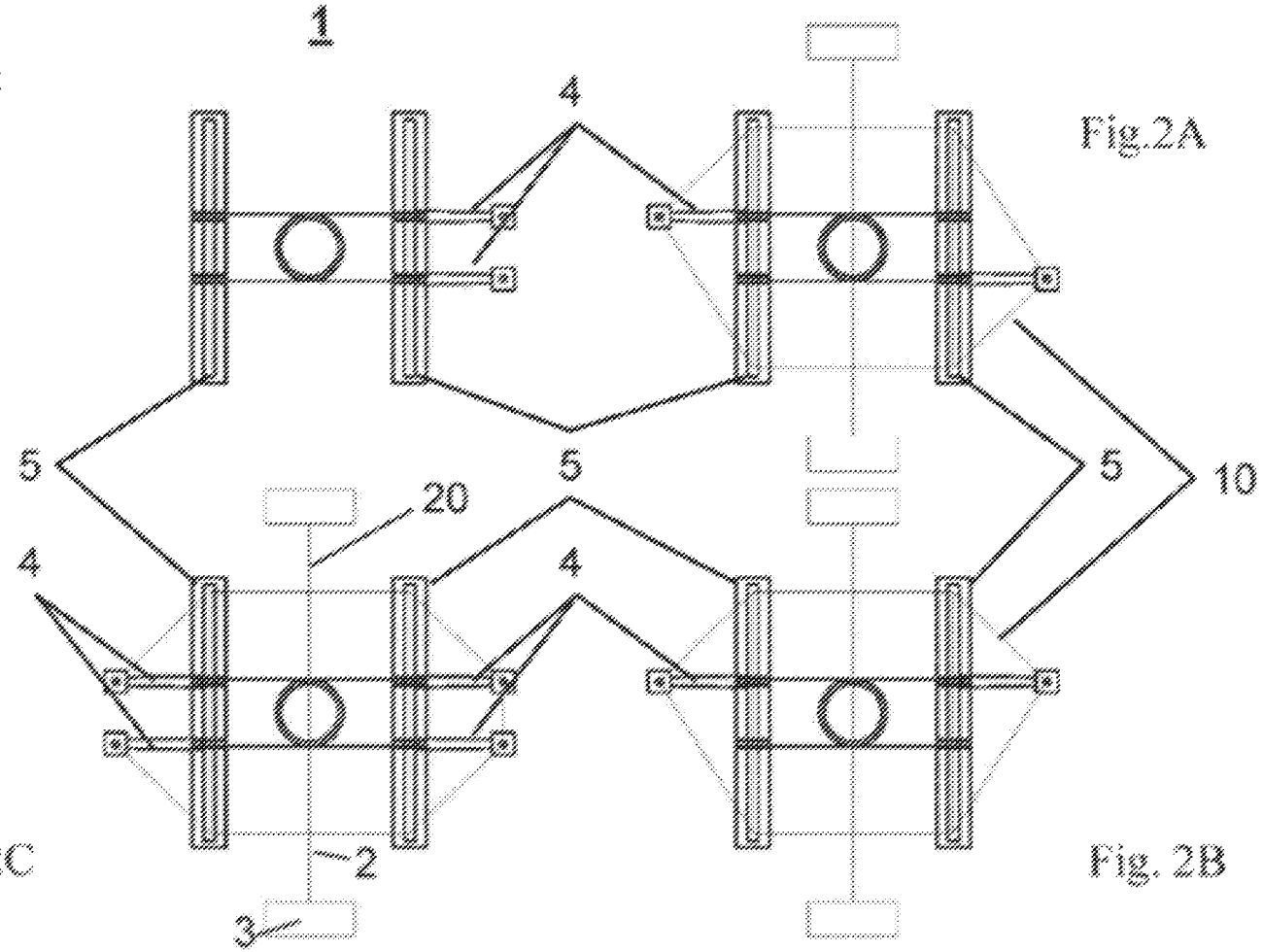
Prior Art Fig. 1
Figure 2H:
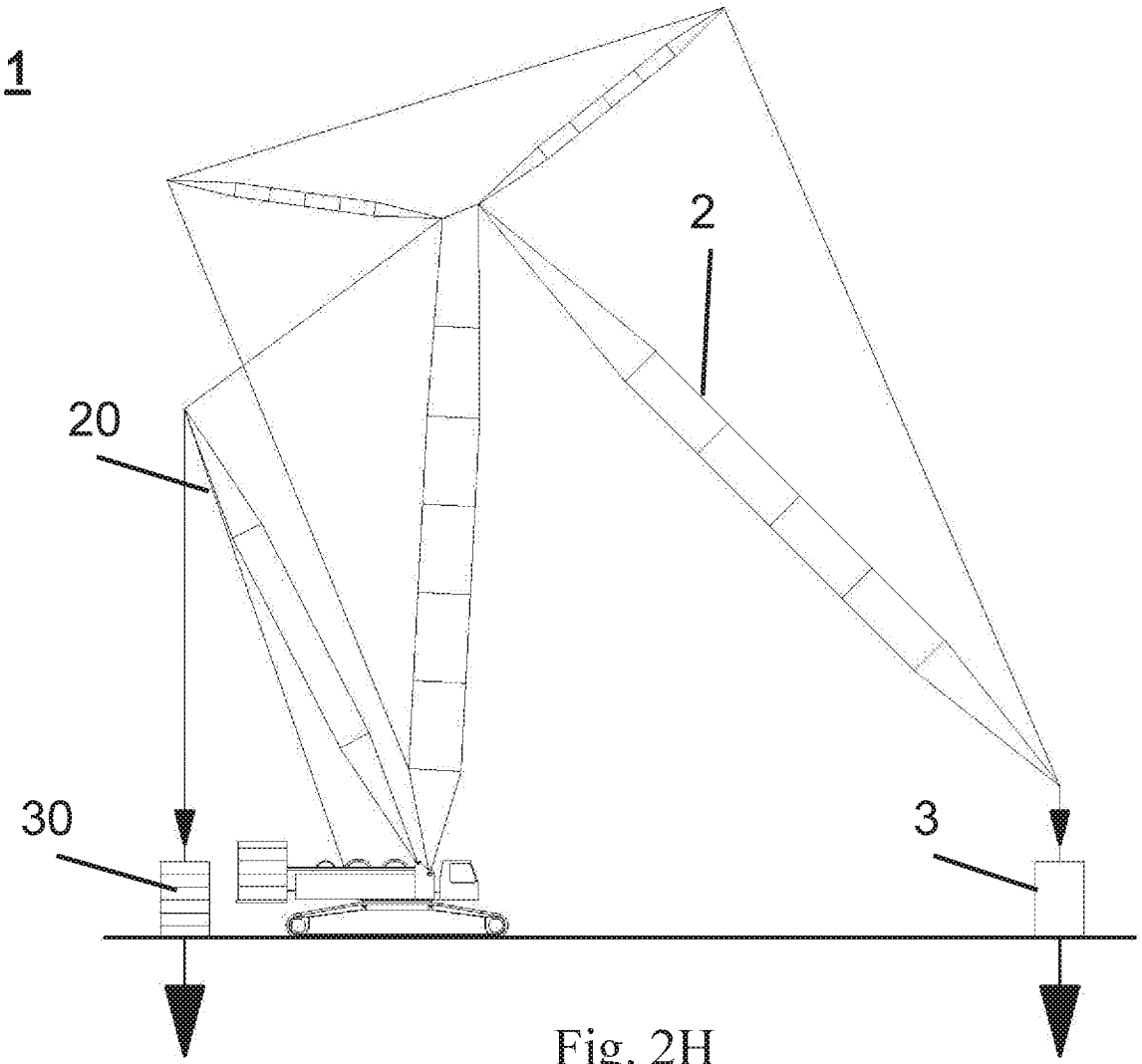
Figure 2I:
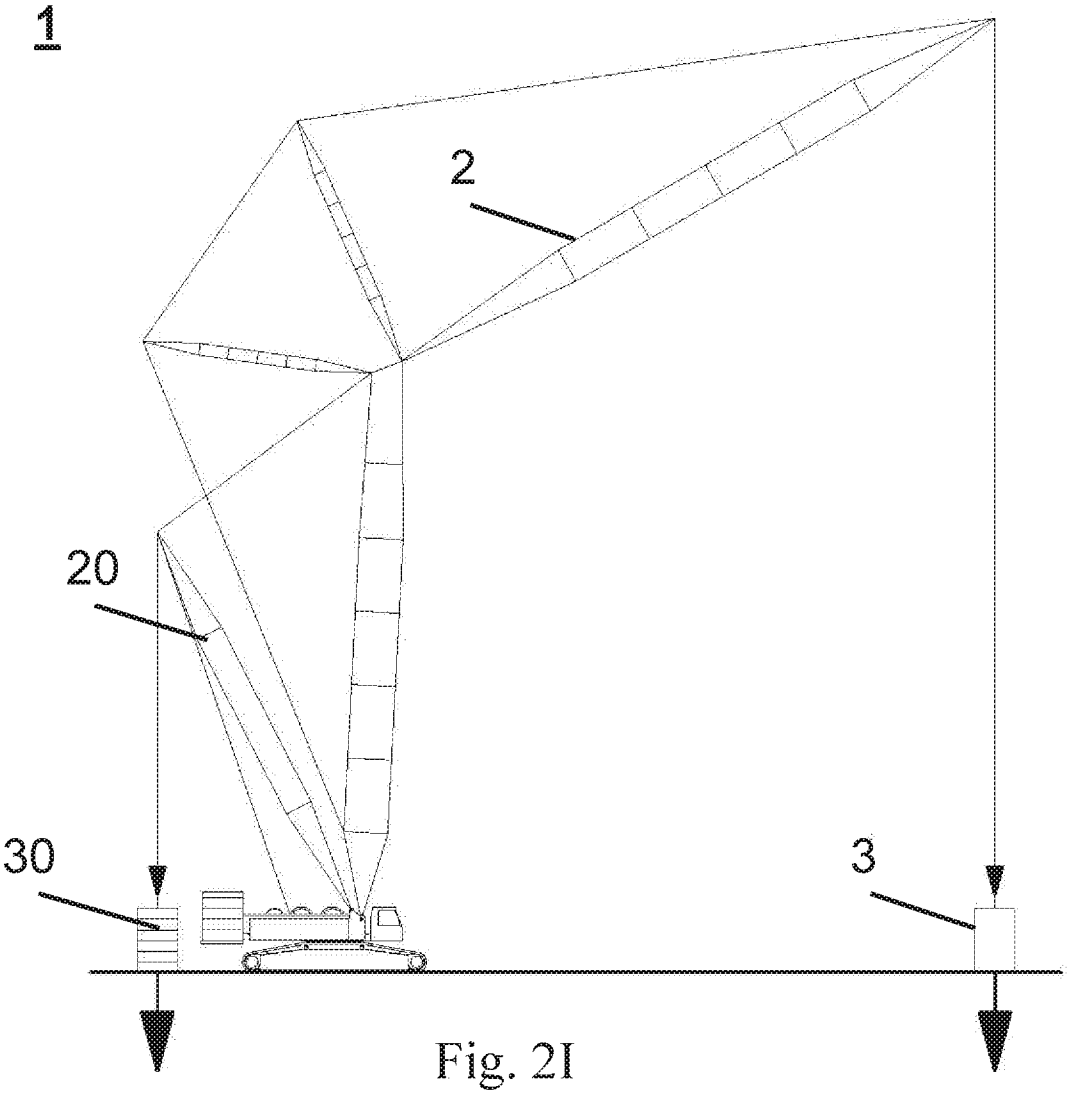

It can be seen from FIGS. 1 and 2A-2I that a crawler-crane 1 can have four or more tilting edges 10. They are formed by the outermost rollers or by the outer footprints of the rollers on the crawler plates and are shown in the Figures by corresponding polygonally extending lines 10. These four or more tilting edges 10 were previously used for observing the maximum permitted wind speed. In accordance with the disclosure, at least one heavy load 3 is now connected to the boom system or to the boom 2. Provision can also be made that a heavy derrick ballast 30 or a second load 30 is connected to the derrick boom or to a second boom 20—if present. Both loads 3, 30 can be placed on the ground or at least be partly pulled. The boom 2 now draws up a part of the load 3 at its outer end via the hoist rope, as shown in FIG. 2I. The total guying hereby takes up a force and holds the boom elements of the crane 1 in position. The total boom system is exposed to compressive strain at its compressed sides.

The derrick boom 20 equally draws up the counterweight system 30 or the second load 30. The counterweight system, for example, comprises a superstructure ballast and/or the derrick ballast 30. The derrick ballast 30 and the superstructure ballast are substantially located with the boom system or with the first and second booms 2, 20 and the load 3 in one plane. Both the load 3 and the derrick ballast 30 are only active to a small extent, that is they only introduce a small portion of their mass as a force into the crane elements. These positions are the so-called "anchorage positions". The "wind anchors" are the load 3 and the derrick ballast 30. With a strong wind, a particularly high wind force now acts on the crane 1. The direction is not defined or can change and therefore has to be assumed in the 360° circle. The force can always be broken down into two force components. One component is in the plane with the boom system and one component is perpendicular thereto. The component that is in the plane of the boom system always effects a further activation of either the derrick ballast 30 or the load 3. Both can therefore be dimensioned such that the tilt of the crane 1 no longer represents the limiting failure criterion. A new limiting failure criterion could therefore be the failure or the breaking of a crane component.

In the described example, suitable measures are still lacking to counteract the force component that acts laterally (above being called perpendicular) onto the boom system. As a rule, crawler cranes have two parallel rectangular footprints, that is tilting edges extending (approximately) in square shape. In accordance with the disclosure, the superstructure can be aligned with the boom system in the direction of travel, as is shown in FIGS. 2H and 2I. Contrary to the previous use of the additional support 4, at least one additional support 4 is now attached to each crawler carrier 5 as is shown in FIGS. 2A to 2C. Depending on the kind of attachment of the additional supports 4, the new tilting edges 10 now arise that are shown partially in the Figures.

FIG. 1 shows a use of a support in accordance with the prior art. FIGS. 2A to 2C show first possible attachment kinds in accordance with the disclosure for the additional supports 4 at the crawler carriers 5. FIGS. 2D to 2G show second attachment possibilities in which the attachment of the additional support 4 to the center frame part 6 or to connection carriers 6' takes place between the center frame part 6 and the crawler carriers. This solution will be selected when the original kind of attachment of the additional support 4 for the setting up was also planned at this point.

Figure 3:
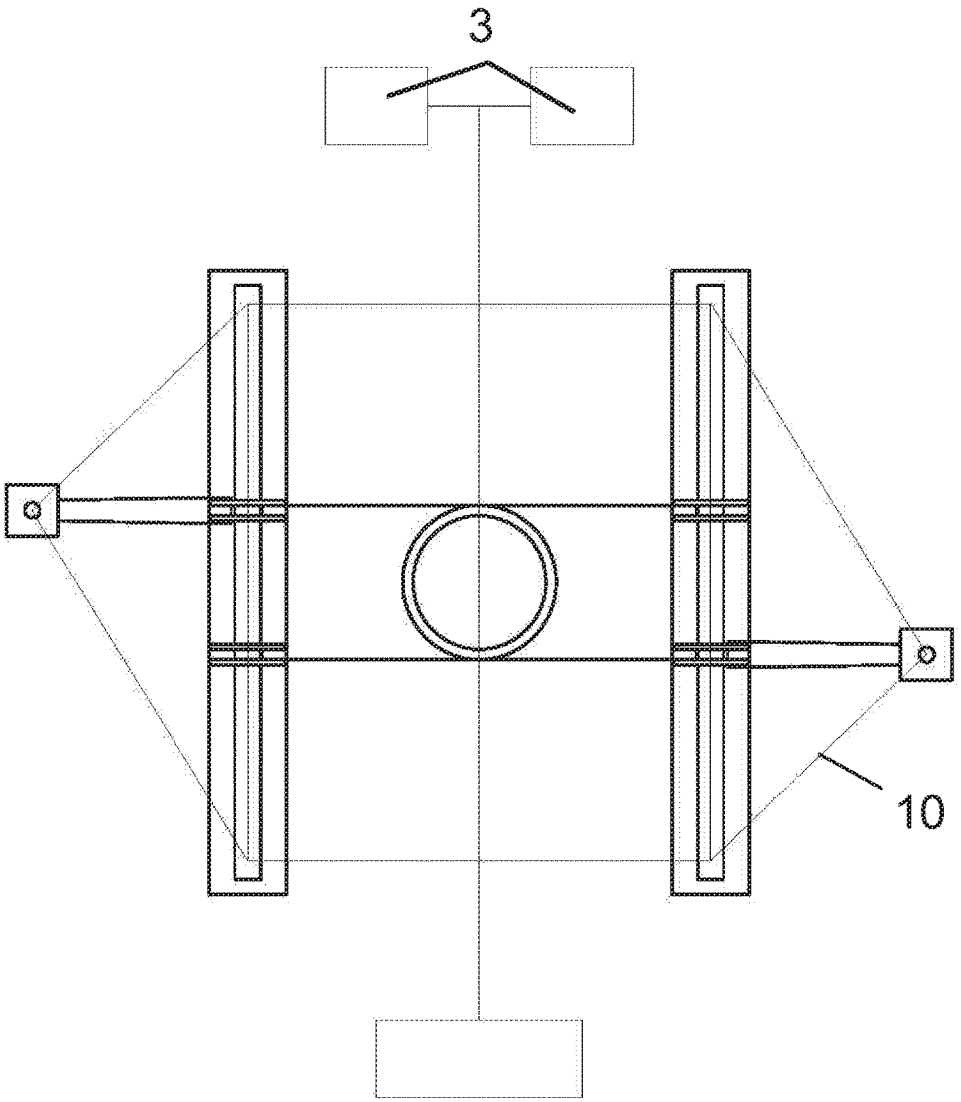
FIG. 3 shows an embodiment with a load divided into two.

FIG. 2I shows the crane 1 with the wind anchors in a side view. FIG. 2H shows a different possible position of the crane 1. A specific boom position has been traveled to here and the load 3 is the hook-type bottom block that does not have to be placed on the ground. FIG. 3 shows a solution in which the load 3 is divided into two. This solution can, for example, be used with a crane 1 in accordance with FIG. 2H. Each side of the partial load is connected to the outer region of the boom 2. If the force component of the wind load acting perpendicular to the boom plane now attempts to turn the crane 1, it is no longer only the slewing gear and, more exactly, the slewing gear brake that is responsible for preventing the rotational movement of the superstructure with the boom system, but actually also the two halves of the load 3. To utilize this advantage, it is necessary that the connection between the outer end of the boom 2 and the load 3 is not too steep. An angle is preferred at which both security measures easily come to bear, in particular approximately 45°. The method of the disclosure can also be performable without a derrick boom.

The invention claimed is:

1. An apparatus for stabilizing a crane in an anchorage position comprising:

at least a first load coupled to a first boom of the crane to compensate a first torque introduced into the crane due to wind; and at least two additional supports each extending away from a different crawler carrier and arranged opposite one another on two opposing lateral sides of the crane to compensate a second torque introduced into the crane due to wind;

wherein the second torque engages at the crane at an angle different from the first torque; and wherein the first load comprises two partial loads arranged next to one another and/or the at least two additional supports are arranged exactly opposite one another or opposite one another and offset.

2. The apparatus in accordance with claim 1, wherein the at least two additional supports are coupled to a plurality of crawler carriers of the crane.

3. The apparatus in accordance with claim 2, further comprising at least two additional supports arranged at a plurality of connection carriers extending between the plurality of crawler carriers.

4. The apparatus in accordance with claim 2, wherein the plurality of crawler carriers comprises exactly one or two or more couplings to couple the at least two additional supports.

5. The apparatus in accordance with claim 3, wherein the plurality of connection carriers comprises exactly one or two or more couplings to couple the at least two additional supports.

6. The apparatus in accordance with claim 1, wherein the at least two additional supports are arranged indirectly or directly at a center frame part of the crane.

7. The apparatus in accordance with claim 6, wherein the center frame part comprises exactly one or two or more couplings to couple the at least two additional supports.

8. The apparatus in accordance with claim 1, wherein the first load is a load applied by a hook-type bottom block of the crane or the first load is the load applied by the hook-type bottom block of the crane and additionally at least partly drawn additional load.

9. The apparatus in accordance with claim 1, wherein a second load is provided at the crane.

10. The apparatus in accordance with claim 9, wherein the second load is a load coupled to the crane via a second boom.

11. The apparatus in accordance with claim 1, wherein the crane is a crawler crane.

12. The apparatus in accordance with claim 1, wherein the at least two additional supports are arranged at a plurality of connection carriers between a plurality of crawler carriers of the crane, and wherein the at least two additional supports are arranged indirectly or directly at a center frame part of the crane.

13. The apparatus in accordance with claim 12, wherein the plurality of crawler carriers, the center frame part, and the plurality of connection carriers each comprise exactly one or two or more couplings to couple the at least two additional supports.

14. The apparatus in accordance with claim 1, where the crane is out of operation.

* * * * *